United States Patent [19]

Gann

[11] Patent Number: 4,501,335

[45] Date of Patent: Feb. 26, 1985

[54] METHOD AND APPARATUS FOR USE IN DRILL STRING MAKE UP

[76] Inventor: Steven N. Gann, 12004 Royal Coach Dr., Yukon, Okla. 73099

[21] Appl. No.: 546,620

[22] Filed: Oct. 28, 1983

[51] Int. Cl.[3] ..... B25B 23/14

[52] U.S. Cl. ..... 173/12; 173/164; 29/240; 81/467; 81/469; 73/862.25

[58] Field of Search ..... 173/12, 164; 29/240; 81/467–483; 73/862.21, 862.25, 862.23, 862.22, 862.26, 862.24

[56] References Cited

U.S. PATENT DOCUMENTS

| | | | |
|---|---|---|---|
| 2,281,226 | 4/1942 | Boles | 73/862.25 |
| 2,527,456 | 10/1950 | Schmeling | 73/862.25 |
| 3,368,396 | 2/1968 | Burkleo | 81/469 |
| 3,693,727 | 9/1972 | Bell | 73/862.25 |
| 3,722,331 | 3/1973 | Raduleson | 81/467 |
| 4,137,758 | 2/1979 | Rodland | 73/862.25 |
| 4,202,208 | 5/1980 | Byrne | 73/862.25 |

*Primary Examiner*—James M. Meister
*Assistant Examiner*—John L. Knoble
*Attorney, Agent, or Firm*—Chris H. Morgan

[57] ABSTRACT

A method and device for use in regulating torque application to a drill string when joining drill string segments using a tong and winch combination. A tension gauge and an angle measuring gauge continuously read tension on the winch line and the angle between the winch line and the tong arm. Actual torque on the drill string segments is calculated thereby and used to deactuate the winch clutch when a desired torque has been applied. A display and printer can display and print torque information as the process of make up proceeds.

5 Claims, 5 Drawing Figures

METHOD AND APPARATUS FOR USE IN DRILL STRING MAKE UP

BACKGROUND OF THE INVENTION

1. Field of the Invention

This invention relates in general to methods and devices for make up or joining of a drill string and, more particularly, to methods and devices for applying torque or a regulated torque in such drill string make up.

2. Description of the Prior Art

In rotary drilling it is necessary to join multiple joints or pieces of a drill pipe or rod as the drilling process proceeds. This process is generally known as drill string make up. It occurs repeatedly as the depth of the drilled hole increases or when the drill string is reassembled after it has been removed from the drilled hole.

Generally drill string make up is accomplished by clamping rotary table jaws to a lower section of pipe and then threading an upper section of pipe to the fixed lower section of pipe. The threading is achieved by connecting a wrench-like device called a tong to the upper section of pipe so that the tong arm extends radially from the pipe with the pipe fixed thereto so that as the tong arm rotates the pipe must rotate. In order to supply sufficient force to the tong arm, a winch and winch line are connected to the tong arm and the winch operated until sufficient torque is applied to the upper drill pipe section to provide a secure rotary shoulder connection between the upper pipe joint and the lower pipe joint. Following make up, the tong arm is released and the drill string lowered until an additional pipe joint may be connected to the drill string. Occasionally a pair of opposing tongs are used instead of relying on the rotary table to hold the lower section of pipe.

A particular problem with the make up process in the past has been that the torque applied to the rotary shoulder connection is both unknown and not precise. This results in a connection which is either too loose allowing foreign matter to produce galls during drilling process or too tight damaging the pins or boxes of the connection.

Various attempts have been made to solve this problem of imprecise torque. However, these methods and devices have not proved satisfactory.

SUMMARY OF THE INVENTION

It is accordingly an object of the present invention to provide a device for use in drill string make up which provides a precise torque application.

It is also an object of the present invention to provide a drill string make up method which precisely applies torque in the make up process.

It is also an object of the present invention to provide a means for calculating the actual torque applied to the drill string during the make up process.

Yet another object of the present invention is to provide a means for displaying and recording the torque applied to a drill string during the make up process.

In accordance with these objects the present invention includes a device for use with a drill string make up tong having a tong arm, a tong winch having a tong winch clutch, and a tong winch line extending between the tong winch and the tong arm. The device comprises an angle sensing means for sensing an angle between the tong arm and the tong winch cable and producing a signal indicative of this angle. A tension sensing means senses tension applied to the tong winch line and produces a signal indicative of this tension. A clutch deactivation means is connected to the angle sensing means and the tension sensing means for receiving signals therefrom and for deactivating the torque winch clutch responsive to the signals from said angle sensing means and said tension sensing means corresponding to a predetermined torque applied to a drill string during make up such that torque greater than this predetermined torque is not applied by the tong winch.

The device also preferably includes a tong arm length recording means for receiving and recording a tong arm length valve so that a torque calculation can be made. A torque calculation means for calculating a torque valve based upon signals from said angle sensing means and said tension sensing means, together with the tong arm length value from the tong arm length recording means calculates the torque applied to a drill string during make up. It produces a signal indicative of this value.

Together with torque calculation means a maximum torque level recording means can be provided to receive a record maximum torque level valve. This maximum torque level value is then compared in a comparison means connected to the torque calculation means and the maximum torque level recording means to produce a signal when the torque is equal to or greater than the maximum torque valve. The signal deactivates the winch clutch ending the application of power to the winch. The maximum torque actually applied to the drill string during make up can be printed by a printing means connected to the torque calculation means. A display means is preferably connected to the torque calculation means for receiving signals therefrom and for selectively displaying torque and other values from the torque calculation means.

The method of the present invention also comprises utilizing a make up tong having a tong arm, a tong winch having a tong winch clutch, and a tong winch line extending between the tong winch and the tong arm. The steps include measuring the length of the tong arm through which the tong winch line applies torque. Then, continuously during the make up process, the angle between the tong arm and the tong winch line is measured and the tension applied to the tong winch line is measured. Using the measurements in the measuring steps the torque applied to a drill string during make up is continuously calculated.

The method also preferably includes the step of deactivating the winch clutch to halt application of torque to the drill string make up when torque calculated in the continuous calculating step equal or exceeds a predetermined level. Steps for recording the maximum torque calculated in the make up process and for continuously displaying an indication of torque calculated in the calculating step are also provided.

For further understanding of the invention and further objects, features and advantages thereof, reference may now be had to the following description taken in conjunction with the accompanying drawings.

DESCRIPTION OF PREFERRED EMBODIMENTS

Figure 1:
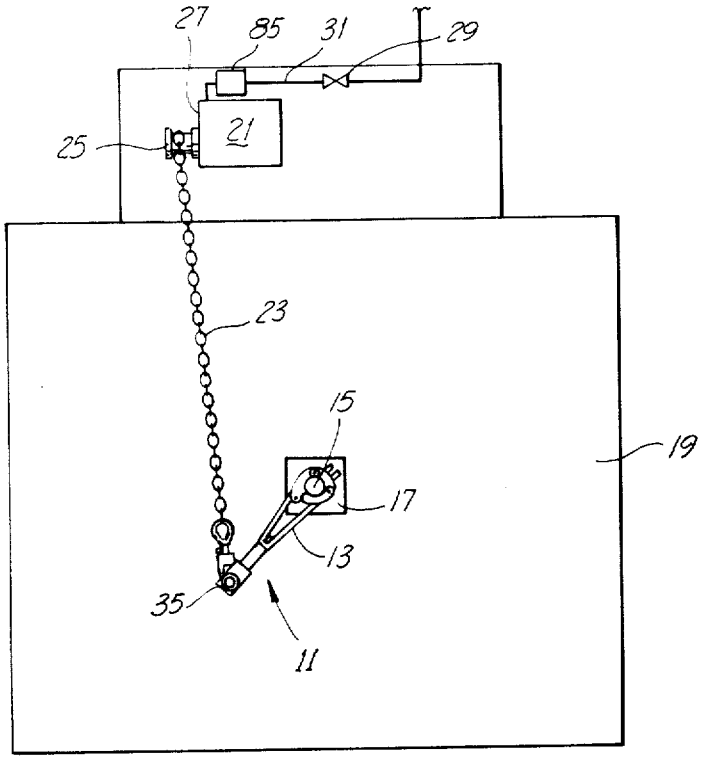
FIG. 1 is a schematic plan view of the device of the present invention in use on a drilling platform.
Figure 2:
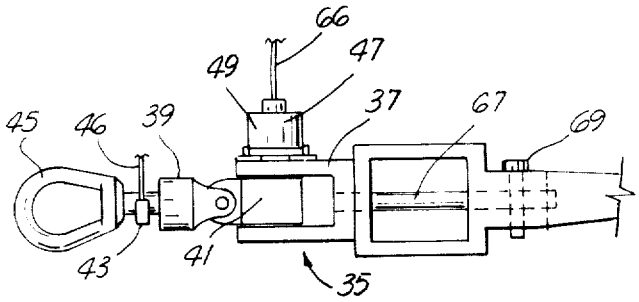
FIG. 2 is side view of a portion of the device of the present invention attached to a tong arm.
Figure 3:
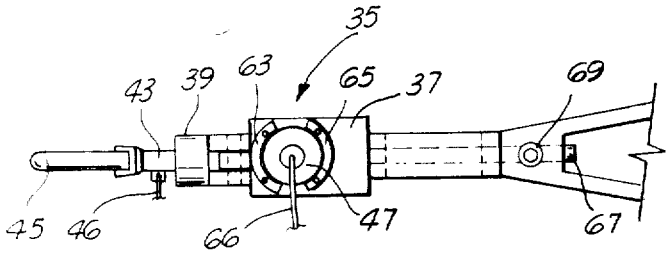
FIG. 3 is a plan view of the device of FIG. 2.
Figure 4:
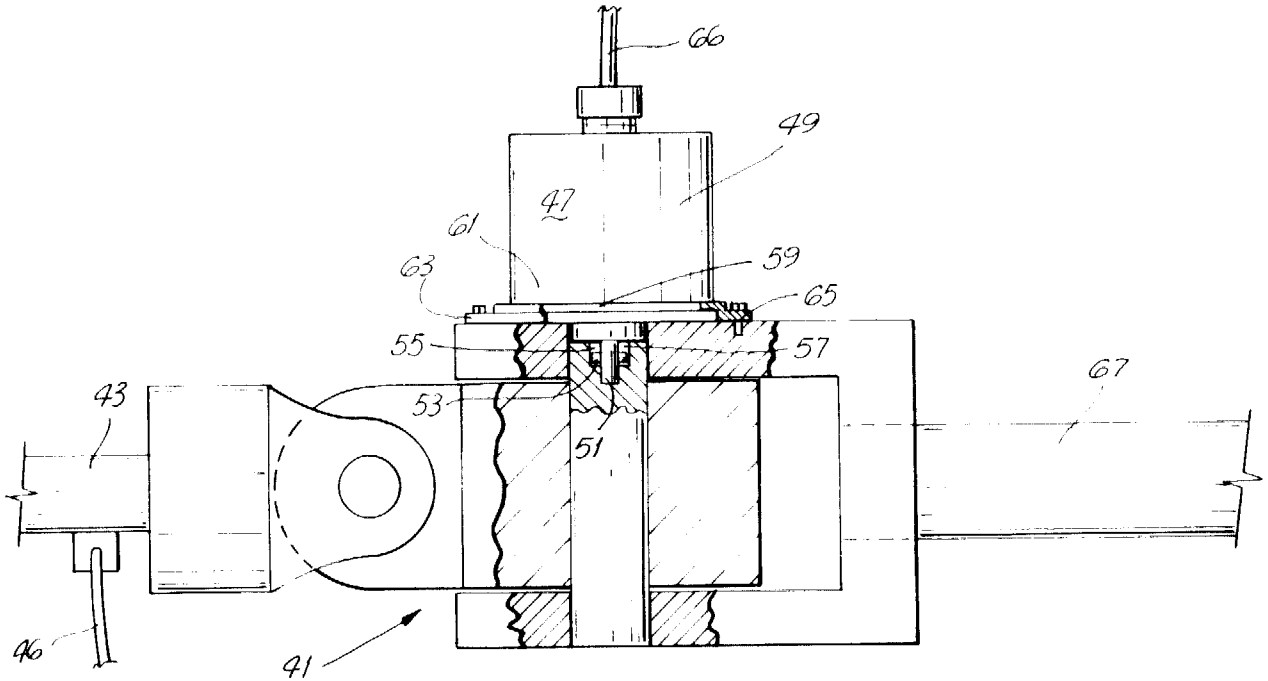
FIG. 4 is an enlarged cutaway side view of a portion of the device shown in FIG. 2.

Referring now to FIG. 1, the mechanical portion of the device of the present invention is shown generally at 11 attached to a conventional tong 13. The tong 13 is shown connected to a drill pipe 15 disposed in a rotary table 17 on a drill platform 19. A winch 21 is mounted on the platform 19. The winch 21 applies tension to a tong winch line 23 wound about the winch drum 25.

The winch 21 includes a winch clutch 27 operated pneumatically by a clutch valve 29 disposed on a pressurized air conduit 31.

In use without the device of the present invention the tong 13 can be conventionally used in make up of a drill string by attaching the tong to a drill pipe section 15 and attaching the winch line 23 to an appropriate portion of the tong arm 33. The clutch valve 29 is manually operated to actuate the winch 21 so as to rotate the winch drum 25 causing the winch line 23 to be tensioned and the tong arm 33 to apply torque tightening the connection between the portion of pipe attached to the tong 13 and the portion fixed in the rotary table 17. The clutch valve is operated to actuate the clutch and release tension on the winch line 23 based on the experience of the operator.

In the past, the amount of torque applied to the drill pipe sections during make up has been estimated by the amount of power applied to the winch 21 during the make up process. Generally, the skill of the winch operator is relied upon to make sure that the made up connection is neither too loose nor too tight. However, despite the efforts of the operator bad connections are made resulting in damage to the pipe connection which could result in catastrophic downhole failures.

One reason for improper connections is that the amount of power applied to the winch is not necessarily proportional to the amount of torque applied to the threaded connection of the drill pipe. This is because the tong arm 13 is not always perpendicular to the winch line 23 at the point when the pipe connection is completed. The present invention solves this problem by providing a device which accounts for the angle between the tong arm 33 and the tong winch line 23, the amount of tension on the tong winch line 23 and the length of the tong 15 through winch the torque is applied. By this means, the present invention calculates the precise torque on the drill pipe. It also displays this torque, records the computed maximum torque for future use and automatically disengages the clutch 27 when the desired torque has been applied.

The device of the present invention measures the angle between the tong winch line 23 and the tong arm 33 by means of a universal connection assembly 35. The assembly 35 includes a tong arm portion 37 which is fixed with respect to the tong arm 33 and a winch line portion 39 which is aligned with the direction of tension from the tong winch line 23. A universal connection 41 joins the tong arm portion 37 to the winch line portion 39 to allow freedom of movement therebetween.

The winch line portion 39 of the assembly 35 has a segment thereof a tension measuring analog strain gauge 43. The tong winch line 23 is attached to the tong winch line portion 39 by a ring 45. The tension measuring strain gauge 43 is disposed between the ring 45 and the universal connection 35 so that tension measured by the tension measuring gauge 43 is the same as the tension in the tong winch line 23 and the same as that applied to the tong arm 33 at the universal connection 41.

Tension measuring gauges such as the tension measuring gauge 43 are well-known devices. A typical tension measuring gauge of the type useful in the present invention is Model No. RM 1075 manufactured by Sensotec. Such a gauge produces an electrical signal indicative of the tension in the gauge 43 so that this signal can be utilized with the other parts of this invention to provide the features described herein. The electrical tension signal from gauge 43 is conveyed to the electrical portion of the invention by an electrical wire 46.

Mounted on the tong arm portion 37 of the assembly 35 is an angle measuring gauge 47. The angle measuring gauge 47 includes a housing 49 and a shaft 51 mounted for rotation in the housing 49. The shaft 51 is fixed to a vertical axis of the universal connection 41 and the housing is fixed to the tong arm portion 37. In this manner, the shaft 51 rotates in housing 49 in accordance with the angle between the tong winch line 23 and the tong arm 33. Thus, measuring the rotation of the shaft 51 with respect to the housing 49 measures the change in angle between the tong winch line 23 and the tong arm 33.

To provide for easy assembly of the angle measuring gauge 47 to the tong arm portion 37 and the universal connection 41, the shaft 51 has a key pin 53 extending radially through the shaft 51. The key pin 53 extends into slots 55 and 57 in the vertical axis of the universal connection 41. Thus, to fix the shaft 51 with respect to the universal connection 41 all that is necessary is to slide the shaft 51 and its key pin 53 into the slots 55 and 57.

The housing 49 has a cylindrical channel 59 extending about its base 61. Cylindrical segment channel engaging flanges 63 and 65 fit within the channel 59 on opposite sides of the base 61 so that, when tightened to the tong arm portion 37 by bolts, the housing 49 is fixed to the tong arm portion 37.

To zero or to adjust the angle between the housing 49 and the shaft 51 the channel engaging flanges 63 and 65 are loosened and the housing 49 is rotated until the desired relationship between the housing 49 and shaft 51 is achieved. The bolts are then tightened to fix the housing 49 in place.

Angle measuring gauges are well-known and one which is suitable for the present invention is model H35A and H35B Optical Encoder made by B.E.I. Electronics, Inc. This device optically measures the direction and amount of rotation between the shaft 51 and the housing 49. An electrical signal indicative of the movement between the shaft and housing is produced thereby. Thus, the electrical signal is indicative of the angle between the tong arm 33 and the tong winch line 23. This signal is conveyed to the electrical portion of the invention by a wire 66.

If desired, separate housings can be positioned about the tension measuring gauge 43 and the angle measuring gauge 47 to protect these devices from collision with tools and other devices used around the drilling platform.

The universal connection assembly 35 can easily be attached to a conventional tong 13. Of course, different tongs have different types of connectors and may require a custom tong arm portion 37 for easy attachment thereto. For the tong 13 shown, a bar 67 can be inserted in place of the usual bar to which the winch line 23 is attached. Once inserted a pin 69 fixes the bar 67 and the tong arm portion 37 with respect to the tong arm 33.

The ring 45 to which the tong winch line is attached also may be adapted for different types of winch lines such as cables or chains and also the type of connector on the winch line such as hooks, eyebolts, etc.

Figure 5:
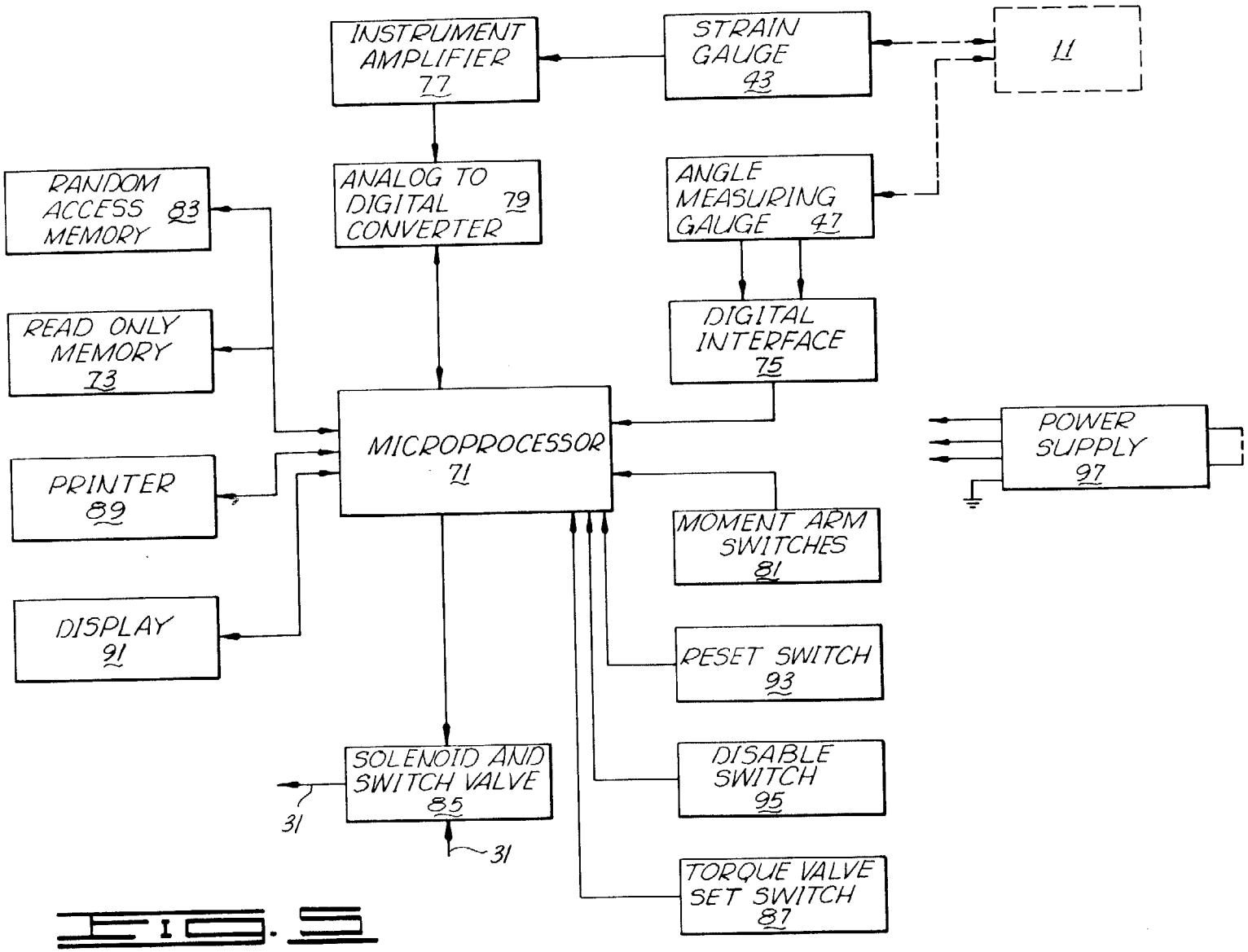
FIG. 5 is a schematic view of the electronic portion of the device of the present invention.

Referring now to FIG. 5, the electrical portion of the device of the present invention is shown schematically. The main element of the electronics is a microprocessor 71 which uses programmed software instructions stored in a read only memory 73 to calculate the amount of torque being applied to the drill string during make up. A microprocessor suitable for use with the present invention is model Z-80 manufactured by Intel.

To provide usable information to the microprocessor 71 from the angle measuring gauge 47, a digital interface 75 is connected between the angle measuring gauge 47 and the microprocessor 71. The digital interface converts the direction and count data from the angle measuring gauge 47 to digital angle information which can be processed by the microprocessor. The digital interface 25 is a part of the angle measuring device sold by B.E.I. Electronics. Of course, the digital angle information is indicative of the angle between the tong winch line 23 and the tong arm 33.

To provide information which can be processed by the microprocessor, an amplifier 77 and an analog to digital converter 79 are connected between the tension measuring gauge 43 and the microprocessor 71. These instruments amplify and convert to digital information the analog tension signal from the tension measuring gauge 43. Of course, the digital information is indicative of the tension on the tong winch line 23.

In order to properly calculate torque, the length of the moment arm must be known. With respect to the present application the length of the moment arm is the length of the tong arm through which torque is applied to the drill string. The present invention can be adjusted for varying tong arm lengths or line connections by moment arm switches 81. The moment arm switches 81 are connected to the microprocessor 71 and the value of the moment arm set thereby is stored by the microprocessor in random access memory 83. Thus, a single manual setting of the moment arm switches communicates the moment arm length to the microprocessor which valve is then stored in the random access memory 83.

Also stored in random access memory are the angle value and tension value indicated by the tension measuring gauge 43 and the angle measuring gauge 47. However, the tension values and the angle values are continuously updated as the make up process proceeds while the moment arm value remains constant. As used herein, the word 'continuously' refers to sufficiently uninterrupted to provide a desired amount of accuracy. Thus, the more frequently the tension value and the angle value are updated the more accurate will be the torque value calculated therefrom.

By means of software stored in the read only memory 73, the microprocessor 71 calculates a torque value from the moment arm value, the tension value and the angle value using a standard trigonometric formula. Of course, the formula varies according to how the angle is calculated and the units for conversion necessary between the values.

To allow the microprocessor 71 to control the application of torque in the process of making up a drill string, a solenoid operated air switch valve 85 is provided on the pressurized air conduit 31. The solenoid operated air switch valve 85 is connected to the microprocessor 71 to receive signals therefrom. Thus, upon an appropriate signal from the microprocessor 71 the air switch valve 85 can be actuated to disengage the clutch 27 to cease operation of the winch 21 and application of torque to the drill string by the tong 13.

In order to provide the microprocessor 71 with a desired maximum torque value at which it will actuate the solenoid air switch valve 85 a desired maximum torque value set switch 87 is connected to the microprocessor 71. By manually operating the switch 87 a desired maximum torque value can be communicated to the microprocessor 71 and loaded into the random access memory 83. As with the moment arm switch 81, the selection need not be continuously updated.

The read only memory software instructions operate to continuously calculate the torque value from the tension value, angle value and moment arm value and then compares this torque value with the maximum torque value stored in the random access memory. When the calculated torque value is equal to or greater than the maximum torque value, the microprocessor signals the solenoid air switch valve 85 to disengage the clutch 27. It is preferable to update or cycle the calculation and comparison at least once every 0.01 second in order to have sufficiently accurate application of torque.

The software instructions used in connection with the present invention are well within the skill of those in the programming art. Of course, many different programs will accomplish the objects of this invention.

A line printer 89 is connected to the microprocessor 71 to allow selected printing of information from the microprocessor 71. One desired set of information to be printed from the microprocessor 71 is the maximum calculated torque value of each made up connection. This information can be printed along with the incremental information concerning which connection corresponds to the maximum calculated torque value. This allows a view of the amount of torque actually used to make up each connection in the drill string.

An alpha-numeric display 91 is connected to the microprocessor 71 to allow continuous display of information from the microprocessor. One desired set of information which can be displayed on the display 91 is the present amount of tension being applied to the drill string and the current angle of winch line and tong arm the maximum amount of torque applied to the drill string after the clutch 27 is disengaged.

Although it is desirable to program the microprocessor 71 to automatically reset following each signal deactuating clutch 27 it is also desirable to provide a reset switch 93 connected to the microprocessor 71 to initiate the calculating and comparing processes.

To operate the device and perform the steps of the present invention, the device 11 is attached to a tong arm 11 and the tong winch line 23 is connected to the ring 45. The tong 13 is then connected to a drill pipe section and the reset switch 93 is actuated to reset the programming. The maximum torque value and the moment arm length are manually loaded by switches 81 and 87 following measurement of the moment arm length and a determination of the desired maximum torque.

At this point, the manual clutch valve 29 is operated and the torque process begins. During the torque application the strain gauge 43 and the angle measuring gauge 47 continuously measure tension in the winch line 23 and the angle between the winch line 23 and the tong arm 33. This information is conveyed to the microprocessor and a continuous calculation of torque applied to the drill string is made using the measurements of tension, angle and moment arm length. When this calculated torque is equal to or greater than the maximum torque value set by switch 87 the solenoid air switch valve is operated to disengage clutch 27 and cease power application to the winch 21.

During this process, the display 91 continuously displays angle and tension information, then the maximum calculated torque. The printer 89 then records the torque and the connection number to which the torque was applied.

A disable switch 95 is provided to manually signal the microprocessor not to operate the valve 85. This disables the device of the present invention so that the winch and tong operates in a conventional manner.

Thus, the method and device of the present invention are well adapted to achieve the objects and advantages mentioned as well as those inherent therein. While presently preferred embodiments of the present invention have been described for the purpose of this disclosure, numerous changes in the details of the method steps and the construction and arrangement of parts can be made by those skilled in the art, which changes are encompassed within the spirit of this invention as defined by the appended claims.

The foregoing disclosure and the showings made in the drawings are merely illustrative of the principles of this invention and are not to be interpreted in a limiting sense.

What is claimed is:

1. A device for use with a drill string make up tong having a tong arm, a tong winch having a tong winch clutch, and a tong winch line extending between said tong winch and said tong arm, comprising:

angle sensing means for sensing an angle between said tong arm and said tong winch cable and producing a signal indicative of said angle;

tension sensing means for sensing tension applied to said tong winch line and producing a signal indicative of said tension; and clutch deactivation means connected to said angle sensing means and said tension sensing means for receiving signals therefrom and for deactivating said torque winch clutch responsive to signals from said angle sensing means and said tension sensing means corresponding to a predetermined torque applied to a drill string during make up such that torque greater than this predetermined torque is not applied by said tong winch.

2. The device of claim 1 wherein said clutch deactivation means further comprises:

tong arm length recording means for receiving and recording a tong arm length value; and torque calculation means for calculating a torque value based upon signals from said angle sensing means and said tension sensing means, and a tong arm length value from said tong arm length recording means, and producing a signal indicative of said value.

3. The device of claim 2 wherein said clutch deactivation means further comprises:

a maximum torque level recording means for receiving and recording a desired maximum torque level value; and a comparison means connected to said torque calculation means and said maximum torque level recording means for comparing a torque value from said torque calculation means and said maximum torque level recording means and producing a signal when said torque value is greater than or equal to said desired maximum torque level value.

4. The device of claim 2 which further comprises:

printing means connected to said torque calculation means for receiving signals therefrom and for selectively printing torque values from said torque calculation means.

5. The device of claim 2 which further comprises:

display means connected to said torque calculation means for receiving signals therefrom and for selectively displaying torque values from said torque calculation means.

* * * * *